United States Patent [19]

Emberson

[11] Patent Number: 4,943,100

[45] Date of Patent: Jul. 24, 1990

[54] DRAIN SUITED FOR INSTALLATION IN WOODEN FLOORS

[75] Inventor: John E. Emberson, Markham, Canada

[73] Assignee: Enpoco Limited, Scarborough, Canada

[21] Appl. No.: 294,704

[22] Filed: Jan. 9, 1989

[30] Foreign Application Priority Data

Jan. 14, 1988 [CA] Canada ..... 556558

[51] Int. Cl.[5] ..... E30F 5/02

[52] U.S. Cl. ..... 210/164

[58] Field of Search ..... 210/163–166

[56] References Cited

U.S. PATENT DOCUMENTS

| | | | |
|---|---|---|---|
| 1,999,277 | 4/1935 | Boosey | 210/483 |
| 2,284,416 | 5/1942 | Gordon | 210/166 |
| 2,672,205 | 3/1954 | McDonald | 210/163 |
| 2,859,452 | 11/1958 | Seewack | 210/165 |
| 3,774,765 | 11/1973 | Kane et al. | 210/164 |

FOREIGN PATENT DOCUMENTS

| | | | |
|---|---|---|---|
| 866031 | 3/1971 | Canada | 210/166 |

*Primary Examiner*—Bernard Nozick

*Attorney, Agent, or Firm*—Fleit, Jacobson, Cohn, Price, Holman & Stern

[57] ABSTRACT

A drain suitable for installation in a wooden floor comprises a body, a grate frame secured to the top of the body, a grate mounted in the frame and a projecting annular flange secured between the body and the grate frame for screw attachment to a deck of the floor.

4 Claims, 2 Drawing Sheets

DRAIN SUITED FOR INSTALLATION IN WOODEN FLOORS

BACKGROUND OF THE INVENTION

This invention is concerned with floor drains and one which is particularly but not exclusively, suited for installation in a wooden floor.

A conventional drain has a body which is set in concrete, a grate frame secured to the top of the body and a grate mounted in the frame. Placing such a drain in a new concrete floor is a simple matter; one merely positions the drain body and pours the concrete. However, placing such a drain in a wooden floor is rather more difficult. The standard technique is to locate a pair of transverse forms between adjacent joists, secure a base form to the joists and transverse forms, locate the drain and pour concrete into the form constituted by the transverse forms, the base form and the joists to which they are attached.

The present invention seeks to simplify the task of setting a drain into a wooden floor.

SUMMARY OF THE INVENTION

According to one aspect of this invention, there is provided a floor drain comprising:

a body;

a grate frame secured to one end of said body;

a grate positioned by said grate frame to overlie said one end; and securing means having upper and lower surfaces, said securing means extending outwardly of said grate frame at a location so that said lower surface overlies a floor deck, said securing means being dimensioned so that the upper surface thereof is substantially level with flooring placed on the floor deck.

Preferably, the securing means comprises an annular flange with screw openings through which screws may be passed to hold the securing means to the deck. The inner portion of the securing means is desirably clamped between the body and the grate frame.

According to another embodiment of this invention, there is provided a method of setting a drain having a body, a grate frame, a grate and securing means extending outwardly of the grate frame, into a deck which comprises forming an opening in the deck of greater size than the grate frame, disposing the drain in said opening with the securing means extending over the marginal edges of the deck about said opening and fastening the securing means to the deck.

An embodiment of the invention is illustrated in the accompanying drawings in which.

Figure 1:
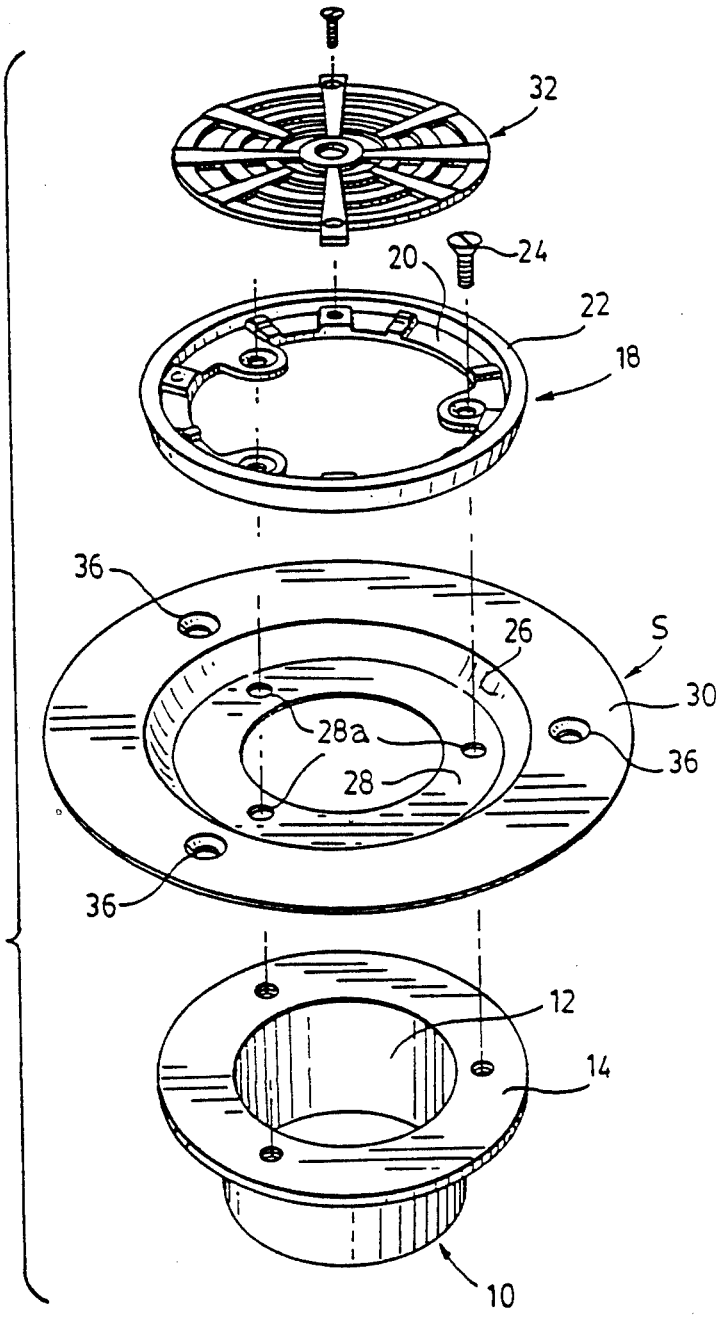
FIG. 1 is an exploded perspective view of a drain according to this invention.
Figure 2:
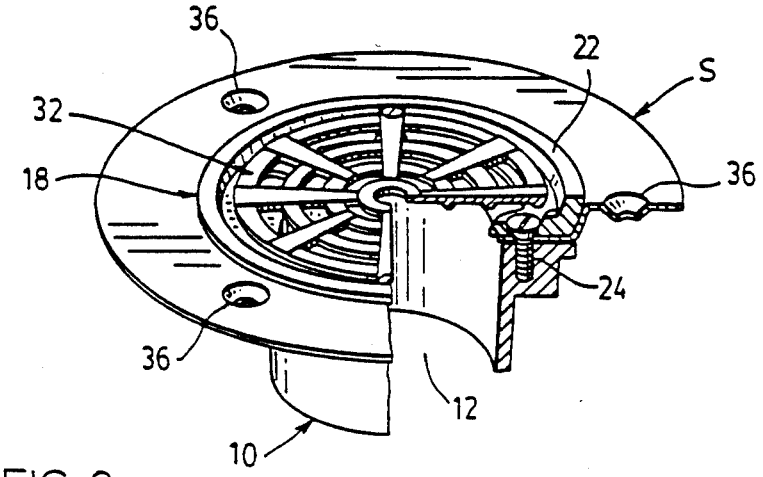
FIG. 2 is a perspective view of the drain of FIG. 1 in assembled form with parts cut away for the purposes of illustration.
Figure 3:
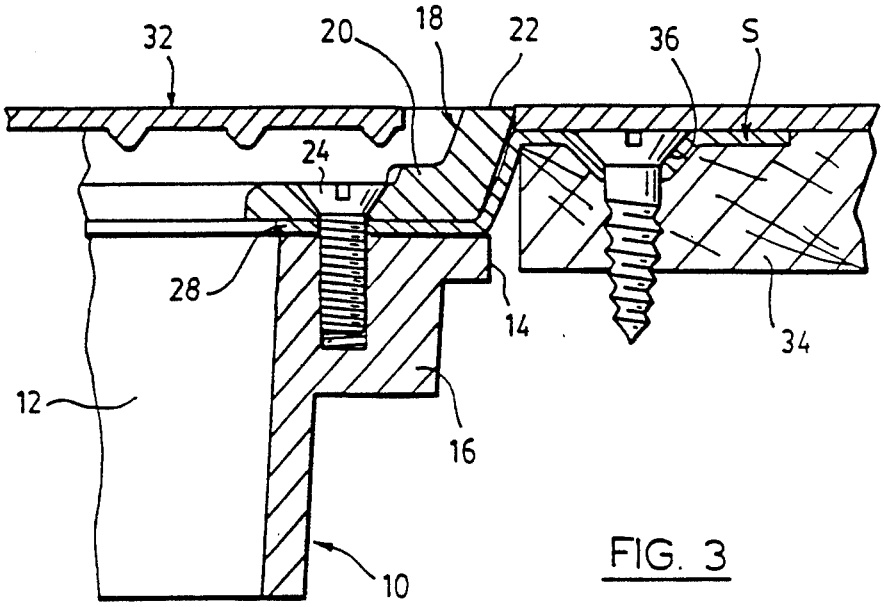
FIG. 3 is a cross-sectional view showing the drain installed in a finished floor.

The drain comprises a body 10 of generally cylindrical form which, in this instance, is internally threaded as at 12 for attachment to an appropriately threaded drain pipe. At the upper edge of the body there is an integral, outwardly directed peripheral flange 14 with three equi-angularly spaced bosses 16 extending from the lower surface of the flange to the outer surface of the cylindrical portion of the body 10. Axially disposed blind threaded holes are formed in the bosses for the attachment of an annular frame grate 18.

The frame grate is of angle section having a radially disposed leg 20 which partially overlies the upper surface of flange 14 of the body and an axial leg 22.

Securing means S comprises a generally axially disposed annular web 26, a radially disposed flange 28 extends inwardly from the lower edge of web 26 between the upper surface of flange 14 of the body and the lower surface of the radially disposed leg 20 of the grate frame and has equiangularly disposed holes **28*a* formed in it. A radially disposed flange 30 extends radially outwards from the upper edge of the web portion 26. A suitable sealing compound is disposed between the adjacent surfaces of flange 28 and the body and grate frame to prevent leakage. Screws 24 are passed through holes in the leg 20 of the grate frame and through holes 28*a* of flange 28 registering with the blind threaded holes in bosses 16** to secure the grate frame and the securing means to the body.

The securing means is designed so that the upper peripheral edge of the grate frame is at a height above the upper surface of the flange 30 equal to the height of the flooring, be it linoleum or tile or any other finishing material, to be applied to the deck in which the drain is to be located.

Set into the grate frame in conventional fashion is a grate 32.

To install the drain, one simply cuts a circular hole in the deck 34 of a diameter slightly larger than the diameter of the web portion of the securing means 24. The drain is then inserted into that opening with flange 30 of the securing means 24 supported on the deck. The drain is secured in place by screws passed through the equiangularly spaced holes 36 of the flange 30. Thereafter, flooring is applied in conventional fashion over flange 30 and up to the marginal edges of the grate frame and the piping is connected to the body 10 in conventional fashion.

It will be recognized by those skilled in the art that the use of the embodiment of the invention here illustrated means that drains can be installed in wooden floors in a much more convenient and simple manner than has been the case in the past. It is also to be appreciated that the securing means could conceivably be formed integrally with either the body of the drain or with the frame grate. However, by the use of the particular embodiment here illustrated, certain economies of materials and manufacturing dies and molds are achieved. It is further to be understood that while the flange of the securing means is illustrated as being continuous, it is conceivable that simple lugs could be used for this purpose. If resort would be had to lugs, they would necessarily have to be more sturdy than the continuous flange of the present embodiment.

We claim:

1. A floor drain comprising:

a tubular body;

a grate frame secured to one end of said body;

a grate positioned by said grate frame to overlie said one end and said grate frame;

securing means for securing said body to said grate frame;

means having upper and lower surfaces and allowing said body to be secured to said grate frame by said securing means, said means extending outwardly of said grate frame at a location so that said lower surface overlies a floor deck, and being dimensioned so that the upper surface thereof is substantially level with floor placed on said floor deck.

2. A drain as claimed in claim 1 wherein the means comprises an annular flange.

3. A drain as claimed in claim 2 wherein an inner peripheral portion of said means is held between adjacent portions of said body and said grate frame.

4. A drain as claimed in claim 3 wherein a sealing compound is applied to opposing surfaces of said means and said body and said grate frame.

* * * * *